US011199050B2

(12) United States Patent
Wang et al.

(10) Patent No.: US 11,199,050 B2
(45) Date of Patent: Dec. 14, 2021

(54) COMBINED CRUSHING SUPER-VARIABLE-DIAMETER DRILL BIT FOR NATURAL GAS HYDRATE EXPLOITATION

(71) Applicants: Southern Marine Science and Engineering Guangdong Laboratory (Zhanjiang), Zhanjiang (CN); Southwest Petroleum University, Chengdu (CN)

(72) Inventors: Guorong Wang, Chengdu (CN); Yang Tang, Chengdu (CN); Xin Jing, Chengdu (CN); Qingyou Liu, Chengdu (CN); Shouwei Zhou, Chengdu (CN); Xushen Li, Zhanjiang (CN); Lin Zhong, Chengdu (CN); Qingping Li, Zhanjiang (CN); Yufa He, Zhanjiang (CN); Zhong Li, Zhanjiang (CN); Yanjun Li, Zhanjiang (CN); Hexing Liu, Zhanjiang (CN); Jianglin Zhu, Zhanjiang (CN); Jiang Lu, Zhanjiang (CN); Leizhen Wang, Chengdu (CN)

(73) Assignees: Southern Marine Science and Engineering Guangdong Laboratory (Zhanjiang); Southwest Petroleum University

( * ) Notice: Subject to any disclaimer, the term of this patent is extended or adjusted under 35 U.S.C. 154(b) by 0 days.

(21) Appl. No.: 17/086,398

(22) Filed: Oct. 31, 2020

(65) Prior Publication Data

US 2021/0140244 A1 May 13, 2021

(51) Int. Cl.
*E21B 10/32* (2006.01)
*E21B 10/43* (2006.01)
(Continued)

(52) U.S. Cl.
CPC ..... *E21B 10/18* (2013.01); *E21B 10/16* (2013.01); *E21B 10/25* (2013.01); *E21B 10/32* (2013.01);
(Continued)

(58) Field of Classification Search
CPC ..... E21B 10/32; E21B 10/322; E21B 10/325; E21B 41/0099
See application file for complete search history.

(56) References Cited

U.S. PATENT DOCUMENTS 865,051 A * 9/1907 Miller ..... E21B 10/32 175/285
1,970,063 A * 8/1934 Steinman ..... E21B 10/32 175/202
(Continued)

FOREIGN PATENT DOCUMENTS

CN 104806170 A 7/2015
CN 105888558 A 8/2016
(Continued)

*Primary Examiner* — Blake Michener

(57) ABSTRACT

The present invention relates to a combined crushing super-variable-diameter drill bit for natural gas hydrate exploitation, including a joint, an outer cylinder connected to the joint by thread, a nozzle I mounted in the outer cylinder, a mechanical locking mechanism, a blade telescoping mechanism, an end cap connected to the outer cylinder by thread, a seal ring IV mounted to the end cap, and a nozzle II mounted in the end cap by threaded connection. The present invention achieves integrated operation of conventional drilling and draw-back expanding, which can effectively solve the problems that the existing hydrate drill bit cannot drill a large borehole, cannot mechanically lock an extending position of the blade to stabilize the size of the borehole, and a single crushing method is inefficient.

4 Claims, 12 Drawing Sheets

(51) Int. Cl.

| | |
|---|---|
| ***E21B 41/00*** | (2006.01) |
| ***E21B 10/18*** | (2006.01) |
| ***E21B 10/16*** | (2006.01) |
| ***E21B 10/25*** | (2006.01) |

(52) U.S. Cl.
CPC ..... *E21B 10/322* (2013.01); *E21B 10/43* (2013.01); *E21B 41/0099* (2020.05)

(56) References Cited

U.S. PATENT DOCUMENTS 2,450,223 A * 9/1948 Barbour ..... E21B 10/32 175/271
2,634,957 A * 4/1953 Coyle ..... E21B 10/322 175/25
3,379,266 A * 4/1968 Fletcher ..... E21B 10/32 175/285
3,443,648 A * 5/1969 Howard ..... E21B 4/20 175/103
3,731,753 A * 5/1973 Weber ..... E21B 10/32 175/285
4,169,510 A * 10/1979 Meigs ..... E21B 21/10 175/267
4,189,184 A * 2/1980 Green ..... E21B 10/18 166/265
4,396,076 A * 8/1983 Inoue ..... E21B 10/32 175/265
4,488,606 A * 12/1984 Inoue ..... E21B 10/32 175/265
4,887,668 A * 12/1989 Lynde ..... B23B 5/16 166/55.8
5,494,121 A * 2/1996 Nackerud ..... E21B 10/32 175/263
6,070,677 A * 6/2000 Johnston, Jr. ..... E21B 47/095 175/57
6,644,422 B1 * 11/2003 Rial ..... E21B 10/32 175/285
6,722,452 B1 * 4/2004 Rial ..... E21B 10/322 175/265
6,962,216 B2 * 11/2005 Zupanick ..... E21B 10/322 166/267
6,976,547 B2 * 12/2005 Rial ..... E21B 10/322 175/263
10,309,178 B2 6/2019 Hart
2004/0011560 A1 * 1/2004 Rial ..... E21B 10/322 175/57
2005/0274546 A1 * 12/2005 Fanuel ..... E21B 10/32 175/57
2006/0131076 A1 * 6/2006 Zupanick ..... E21B 43/006 175/57
2012/0080231 A1 * 4/2012 Radford ..... E21B 10/322 175/57
2013/0032406 A1 * 2/2013 Comeaux ..... E21C 37/18 175/57
2016/0258221 A1 * 9/2016 Macha ..... E21B 10/325
2016/0290054 A1 * 10/2016 Weaver ..... E21B 10/325
2020/0240215 A1 * 7/2020 Estes ..... E21B 7/28

FOREIGN PATENT DOCUMENTS

CN 107083923 A 8/2017
CN 110259418 A 9/2019
GB 2172632 A * 9/1986 ..... E21B 10/32
GB 2430949 A * 4/2007 ..... E21B 10/32
WO 2019075508 A1 4/2019

* cited by examiner

COMBINED CRUSHING SUPER-VARIABLE-DIAMETER DRILL BIT FOR NATURAL GAS HYDRATE EXPLOITATION

CROSS-REFERENCE TO RELATED APPLICATIONS

This application claims priority to Chinese Application No. 201911088648.8, filed on Nov. 8, 2019, entitled "automatic jet breaking tool for solid fluidization exploitation of natural gas hydrate". These contents are hereby incorporated by reference.

TECHNICAL FIELD

The present invention relates to the technical field of natural gas hydrate drilling and exploitation, and particularly to a combined crushing super-variable-diameter drill bit for natural gas hydrate exploitation.

BACKGROUND

Natural gas hydrate is a "cage compound" synthesized by natural gas and water molecules under low temperature and high pressure conditions. 80% to 90% of the components in the natural gas hydrate are methane, and thus the natural gas hydrate is also referred to as methane hydrate. It is also referred to as "combustible ice" because it is mostly white or light gray crystals, looks like ice and can be ignited like a lump of alcohol. The natural gas hydrate exists widely in the world. The discovered natural gas hydrate exists mainly in the permafrost regions of the Arctic region and in the sea floor, continental slopes, land bases and sea trenches around the world. At present, the main exploitation methods of natural gas hydrate include depressurization production, heat injection exploitation, and solid fluidization exploitation. The three methods have a common feature that a large borehole needs to be opened to achieve the purpose of efficiently exploiting the hydrate. In the depressurization production and heat injection exploitation methods, a large borehole needs to be mined to achieve efficient depressurization or heat injection and to achieve efficient exploitation of natural gas hydrate. In the solid fluidization exploitation method, mining equipment is used to crush a solid hydrate reservoir into fine particles which are transported to an offshore platform by sealed fluidization and then after-treated and processed on the platform. In mining, a larger borehole indicates a higher output of a single borehole; so it is necessary to open a large borehole in order to achieve the purpose of efficient exploitation.

At present, in downhole tools of natural gas hydrate exploitation, main tools that can form a large borehole include a hydrate drill bit, a pressure-controlled sliding cylinder, and an umbrella exploitation tool. However, none of them can meet the requirements of high efficiency and high output of natural gas hydrate, and each of them has some shortcomings, which are specifically as follows:

(1) A hydrate exploitation drill bit cannot implement an expanding function, let alone form a large borehole, resulting in low productivity and high operating costs of a single borehole.

(2) The pressure-controlled sliding cylinder adopts the pure water force to crush the hydrate, resulting in insufficient crushing capability, which will lead to an unstable and irregular size of the borehole, and the particle size of the hydrate debris formed is large, which cannot meet the requirements of solid fluidization recovery of natural gas hydrate.

(3) Existing umbrella exploitation tools do not have a drilling function, which may increase the drilling procedures and waste unnecessary costs and time. Moreover, simple mechanical crushing is insufficient in crushing capability, and it is difficult to maintain and realize that the blade is opened under coordination of a double-layered tube in long-distance exploitation.

At the same time, there are also some problems with the existing variable-diameter drill bits for oil extraction in the market. For example, when the variable-diameter drill bits for oil extraction are in operation, the borehole expanding rate is very small, which is not enough to form a large borehole suitable for efficient natural gas hydrate exploitation, resulting in low natural gas hydrate crushing efficiency. The lack of the mechanical locking mechanism results in large borehole size fluctuation and low expanding efficiency.

Therefore, a variable-diameter drill bit for natural gas hydrate exploitation is required to form a larger borehole, to achieve the purpose of efficient natural gas hydrate exploitation. Thus, in view of the existing problems in hydrate drill bits and tools as well as the requirements for efficient hydrate exploitation, it is currently urgent to solve the problems of how to achieve automatic expanding of drill bits to drill a larger borehole, how to mechanically lock an extending position of the blade to stabilize the size of the borehole, and how to combine mechanical crushing with hydraulic crushing to improve the crushing efficiency.

SUMMARY OF THE INVENTION

An objective of the present invention is to provide a combined crushing super-variable-diameter drill bit for natural gas hydrate exploitation with respect to the defects in use of existing natural gas hydrate exploitation tools, so as to solve the problems that the existing hydrate exploitation tools cannot drill a large borehole and cannot mechanically lock an extending position of the blade to stabilize the size of the borehole, and a single crushing method is inefficient. In the drill bit, a long blade is used to drill a large borehole and achieve efficient natural gas hydrate exploitation. In the drill bit, a mechanical locking mechanism is used to achieve mechanical locking of an extending position of the blade and stabilize the size of the borehole. The drill bit combines mechanical crushing with hydraulic crushing to improve the crushing efficiency of the drill bit, so as to achieve the purpose of extracting hydrate debris with a relatively small particle size. Moreover, on the basis of solving the above problems, the blade can also be controllably retracted, and the blade can be retracted and released when stuck, so as to effectively prevent the blade from being stuck or even broken.

The present invention patent adopts the following technical solution to solve the technical problems thereof: a combined crushing super-variable-diameter drill bit for natural gas hydrate exploitation, including: a joint, an outer cylinder connected to the joint by thread, a nozzle I mounted in the outer cylinder, a mechanical locking mechanism, a blade telescoping mechanism, an end cap connected to the outer cylinder by thread, a seal ring IV mounted to the end cap, and a nozzle II mounted in the end cap by threaded connection, wherein an upper portion of the outer cylinder is provided with a seal ring groove I, a middle-upper portion of the outer cylinder is provided with a step I, raised jaws in three positions are circumferentially distributed in a middle portion of the outer cylinder, a seal ring groove II is disposed below the jaws, nozzle holes I in three positions are circumferentially disposed below the seal ring groove II, there are 4 holes in each position, a seal ring groove III is disposed below the nozzle holes I, rectangular through holes in three positions are circumferentially disposed in a middle-lower portion of the outer cylinder, a lower portion of the rectangular through holes is provided with a chute, and a step II is disposed in an inner lower portion of the outer cylinder;

the mechanical locking mechanism consists of a pressure cylinder, a seal ring I, a spring I, a jaw sleeve, a seal ring II, and a seal ring III, an upper end of the pressure cylinder is limited by a lower end face of the upper joint, the seal ring I is disposed between the pressure cylinder and the outer cylinder, the spring I is located in the outer cylinder and two ends thereof are respectively connected between a step of the pressure cylinder and the step inside the outer cylinder, the pressure cylinder is in contact with the jaw sleeve, and the seal ring II and the seal ring III are disposed between the jaw sleeve and the outer cylinder;

the blade telescoping mechanism consists of a thrust ball bearing, a sliding cylinder, a spring II, a blade, a secondary crushing connecting rod, and a blade connecting base, the thrust ball bearing is mounted between the jaw sleeve and the sliding cylinder, the sliding cylinder is in clearance fit with the jaw sleeve, the spring II is connected between the sliding cylinder and the step in the outer cylinder, the blade connecting base is connected to the sliding cylinder by bolt, two ends of the secondary crushing connecting rod are respectively connected to the blade and the outer cylinder by bolt, the blade is connected to the blade connecting base by bolt, wherein an upper end of the secondary crushing connecting rod is provided with a through hole III, a left side of the secondary crushing connecting rod is provided with two rows of raised crushing teeth, two sides of the crushing teeth are symmetrically provided with two rows of notches, a lower end of the secondary crushing connecting rod is provided with a through hole IV, and a groove I is disposed in the middle of the secondary crushing connecting rod, to make the secondary crushing connecting rod take the shape of a fork;

an upper end of the end cap is provided with a seal ring groove IV, the middle of the end cap is provided with a step V, and the end cap is circumferentially provided with nozzle holes in three positions; and the nozzle II is mounted in the nozzle holes in the end cap.

In the mechanical locking mechanism, the pressure cylinder is provided with a necked step opening, a step III, recesses in three positions, and helical surfaces in three positions, the necked step opening is disposed on the inside of the pressure cylinder, the step III is disposed on the outside of the pressure cylinder, the recesses in three positions are disposed along a circumferential direction of an outer wall of the pressure cylinder, the helical surfaces in three positions are disposed at a lower end of the pressure cylinder, and sections in three positions are disposed on the helical surfaces in three positions;

an upper end of the jaw sleeve is provided with helical surfaces in six positions, sections in three positions, gaps in three positions, and a step IV, the sections in three positions and the gaps in three positions are intersected between every two helical surfaces, and the step IV is disposed in the middle of the jaw sleeve; and the recesses match with the jaws, and the helical surfaces on the pressure cylinder are in contact with the helical surfaces on the jaw sleeve.

In the blade telescoping mechanism, the blade includes a through hole I, cutting teeth, flat teeth, a through hole II, a special-shaped groove, flat teeth, and ball teeth, the through hole I is disposed on an upper end of the blade, the cutting teeth are uniformly disposed along edges of the blade, two rows of flat teeth are disposed on an outer side of the blade, the through hole II is disposed in a middle portion of the blade, the special-shaped groove is disposed on the blade, the flat teeth of the blade are disposed a lower outer side of the blade, and the ball teeth are disposed at a lower end of the blade; the blade connecting base is provided with a bolt through hole, a through hole V, and a groove II; the blade connecting base is connected to the sliding cylinder through a bolt through hole by using a bolt, the through hole I is connected to the through hole V by bolt, to make the blade connected to the blade connecting base, the through hole II is connected to the through hole III by bolt, to make the middle portion of the blade connected to the secondary crushing connecting rod by bolt, and the secondary crushing connecting rod is connected to the outer cylinder through the through hole IV by using a bolt.

When the device is drilling, the blade is closed, front ends of three blades form a drill bit to drill forward, and the nozzle II assists in crushing and cleaning the blades; when the drill bit drills to the end of a hydrate layer, the blades begin to open, and the nozzle I on the outer cylinder is opened while the blades are opened, to achieve hydrate hydraulic crushing; after the blades are opened, the drill bit begins to draw back, in which case the blades rotate to crush the hydrate to achieve mechanical crushing of the hydrate; the secondary crushing connecting rod rotates while the blades rotate, the crushing teeth and the notches on the secondary crushing connecting rod coordinate with each other to continue to crush the hydrate to achieve secondary mechanical crushing of the hydrate.

The present invention has the following beneficial effects:

1) In the drill bit, a long blade is adopted to drill a large borehole during drilling, which can meet the requirements of efficient hydrate exploitation.

2) The drill bit adopts a new mechanical locking manner, which can achieve reliable mechanical locking of the blades, and prevent the blades from retracting due to formation pressure fluctuation during expanding, so as to ensure the stability of the blade expanding crushing.

3) The drill bit combines mechanical crushing with hydraulic crushing, which can achieve the purpose of extracting hydrate debris with a relatively small particle size.

4) According to the drill bit, the blade can also be controllably retracted, and the blade can be retracted and released when stuck, so as to effectively prevent the blade from being stuck or even broken.

5) During drilling of the drill bit, the blade is in a closed state, rock crushing is carried out at the front end, and opening the blade during draw-back can prevent the hydrate layer from collapsing and burying the drilling tool when it is expanding.

Figure 1:
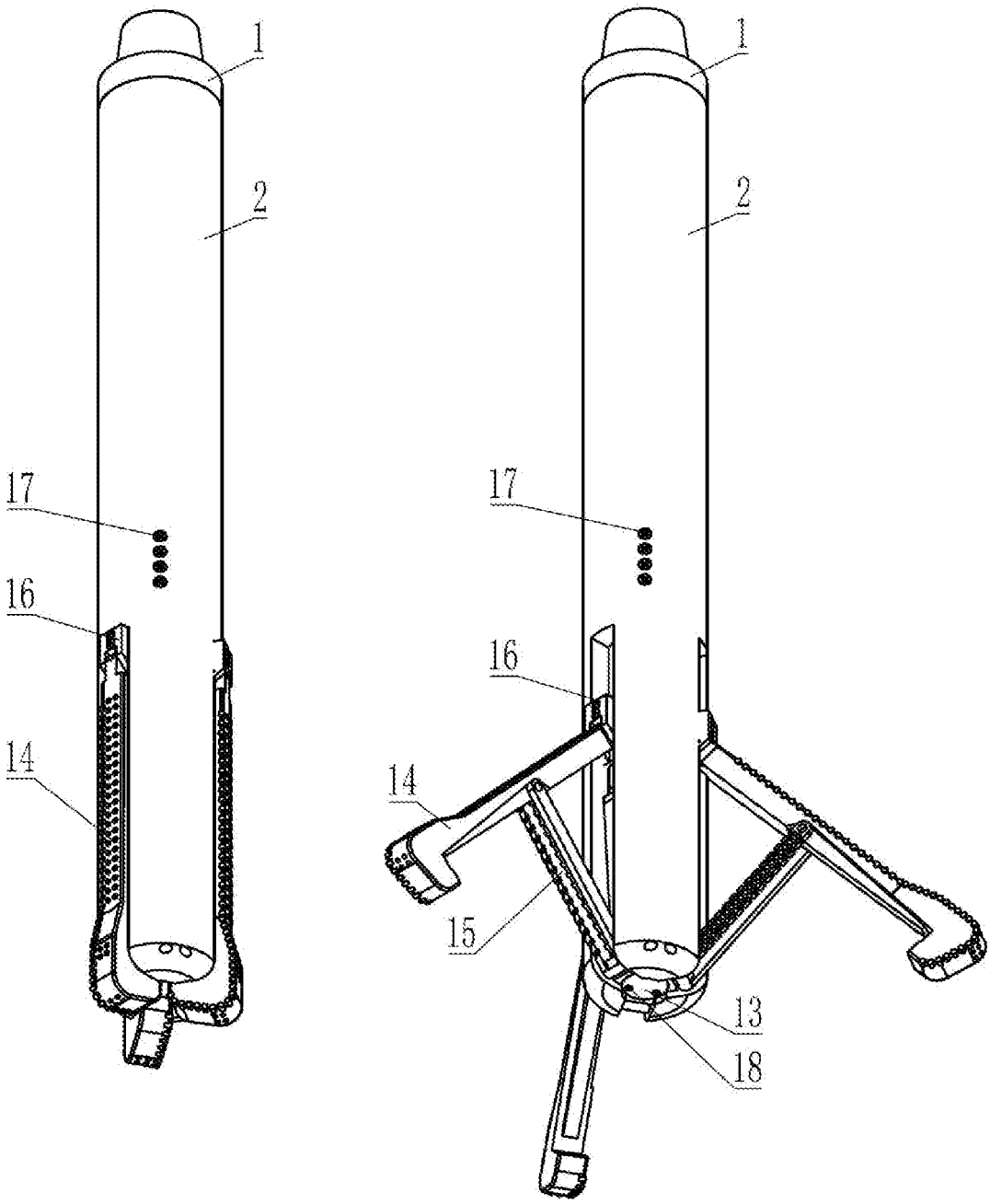
FIG. 1 is an external view of the present invention.

In the figures, 1: joint; 2: outer cylinder; 3: pressure cylinder; 4: seal ring I; 5: spring I; 6: jaw sleeve; 7: seal ring II; 8: seal ring III; 9: thrust ball bearing; 10: sliding cylinder; 11: spring II; 12: seal ring IV; 13: end cap; 14: blade; 15: secondary crushing connecting rod; 16: blade connecting base; 17: nozzle I; 18: nozzle II; 201: seal ring groove I, 202: step I; 203: jaw; 204: seal ring groove II; 205: nozzle hole I, 206: seal ring groove III; 207: rectangular through hole, 208: step II; 209: chute; 301: necked step opening; 302: step III; 303: recess; 304: section; 305: helical surface I; 601: helical surface II; 602: section; 603: gap; 604: step IV; 1301: seal ring IV; 1302: step V; 1303: nozzle hole II; 1401: through hole I; 1402: cutting tooth; 1403: flat tooth; 1404: through hole II; 1405: special-shaped groove; 1406: flat tooth; 1407: ball tooth; 1501: through hole III; 1502: crushing tooth; 1503: notch; 1504: through hole IV; 1505: groove I, 1601: bolt through hole; 1602: through hole V; 1603: groove II.

DETAILED DESCRIPTION OF PREFERRED EMBODIMENTS

The present invention is further described below with reference to the accompanying drawings, and the protection scope of the present invention is not limited to the following description.

As shown in FIG. 1 to FIG. 12, a combined crushing super-variable-diameter drill bit for natural gas hydrate exploitation includes: a joint 1, an outer cylinder 2 connected to the joint 1 by thread, a nozzle I 17 mounted in the outer cylinder 2, a mechanical locking mechanism, a blade telescoping mechanism, an end cap 13 connected to the outer cylinder 2 by thread, a seal ring IV 12 mounted to the end cap 13, and a nozzle II 18 mounted in the end cap 13 by threaded connection, wherein an upper portion of the outer cylinder 2 is provided with a seal ring groove I 201, a middle-upper portion of the outer cylinder 2 is provided with a step I 202, raised jaws 203 in three positions are circumferentially distributed in a middle portion of the outer cylinder 2, a seal ring groove II 204 is disposed below the jaws 203, nozzle holes I 205 in three positions are circumferentially disposed below the seal ring groove II 204, there are 4 holes in each position, a seal ring groove III 206 is disposed below the nozzle holes I 205, rectangular through holes 207 in three positions are circumferentially disposed in a middle-lower portion of the outer cylinder 2, a lower portion of the rectangular through holes 207 is provided with a chute 209, and a step II 208 is disposed in an inner lower portion of the outer cylinder 2;

the mechanical locking mechanism includes a pressure cylinder 3, a seal ring I 4, a spring I 5, a jaw sleeve 6, a seal ring II 7, and a seal ring III 8, an upper end of the pressure cylinder 3 is limited by a lower end face of the upper joint 1, the seal ring I 4 is disposed between the pressure cylinder 3 and the outer cylinder 2, the spring I 5 is located in the outer cylinder 2 and two ends thereof are respectively connected between a step of the pressure cylinder 3 and the step inside the outer cylinder 2, the pressure cylinder 3 is in contact with the jaw sleeve 6, and the seal ring II 7 and the seal ring III 8 are disposed between the jaw sleeve 6 and the outer cylinder 2;

the blade telescoping mechanism includes a thrust ball bearing 9, a sliding cylinder 10, a spring II 11, a blade 14, a secondary crushing connecting rod 15, and a blade connecting base 16, the thrust ball bearing 9 is mounted between the jaw sleeve 6 and the sliding cylinder 10, the sliding cylinder 10 is in clearance fit with the jaw sleeve 6, the spring II 11 is connected between the sliding cylinder 10 and the step in the outer cylinder 2, the blade connecting base 16 is connected to the sliding cylinder 10 by bolt, two ends of the secondary crushing connecting rod 15 are respectively connected to the blade 14 and the outer cylinder 2 by bolt, the blade 14 is connected to the blade connecting base 16 by bolt, wherein an upper end of the secondary crushing connecting rod 15 is provided with a through hole III 1501, a left side of the secondary crushing connecting rod 15 is provided with two rows of raised crushing teeth 1502, two sides of the crushing teeth 1502 are symmetrically provided with two rows of notches 1503, a lower end of the secondary crushing connecting rod 15 is provided with a through hole IV 1504, and a groove I 1505 is disposed in the middle of the secondary crushing connecting rod 15, to make the secondary crushing connecting rod 15 take the shape of a fork; an upper end of the end cap 13 is provided with a seal ring groove IV 1301, the middle of the end cap 13 is provided with a step V 1302, and the end cap 13 is circumferentially provided with nozzle holes II 1303 in three positions; and the nozzle II 18 is mounted in the nozzle holes II 1303.

In the mechanical locking mechanism of the present invention, a necked step opening 301 is disposed on the inside of the pressure cylinder 3, a step III 302 is disposed on the outside of the pressure cylinder 3, recesses 303 in three positions are disposed along a circumferential direction of an outer wall of the pressure cylinder 3, helical surfaces I 305 in three positions are disposed at a lower end of the pressure cylinder 3, and sections 304 in three positions are disposed on the helical surfaces I 305 in three positions; an upper end of the jaw sleeve 6 is provided with helical surfaces II 601 in six positions, sections 602 in three positions and gaps 603 in three positions are intersected on the six helical surfaces II 601, and a step IV 604 is disposed in the middle of the jaw sleeve 6; and the recesses 303 match with the jaws 203, and the helical surfaces I 305 on the pressure cylinder 3 are in contact with the helical surfaces II 601 on the jaw sleeve 6.

In the blade telescoping mechanism in the present invention, the blade 14 includes a through hole I 1401, cutting teeth 1402, flat teeth 1403, a through hole II 1404, a special-shaped groove 1405, flat teeth 1406, and ball teeth 1407, the through hole I 1401 is disposed on an upper end of the blade 14, the cutting teeth 1402 are uniformly disposed along edges of the blade 14, two rows of flat teeth 1403 are disposed on an outer side of the blade 14, the through hole II 1404 is disposed in a middle portion of the blade 14, the special-shaped groove 1405 is disposed on the blade 14, the flat teeth 1406 of the blade 14 are disposed a lower outer side of the blade 14, and the ball teeth 1407 are disposed at a lower end of the blade 14; the blade connecting base 16 is provided with a bolt through hole 1601, a through hole V 1602, and a groove II 1603; the blade connecting base 16 is connected to the sliding cylinder 10 through a bolt through hole 1601 by using a bolt, the through hole I 1401 is connected to the through hole V 1602 by bolt, to make the blade 14 connected to the blade connecting base 16, the through hole II 1404 is connected to the through hole III 1501 by bolt, to make the middle portion of the blade 14 connected to the secondary crushing connecting rod 15 by bolt, and the secondary crushing connecting rod 15 is connected to the outer cylinder 2 through the through hole IV 1504 by using a bolt.

Figure 2:
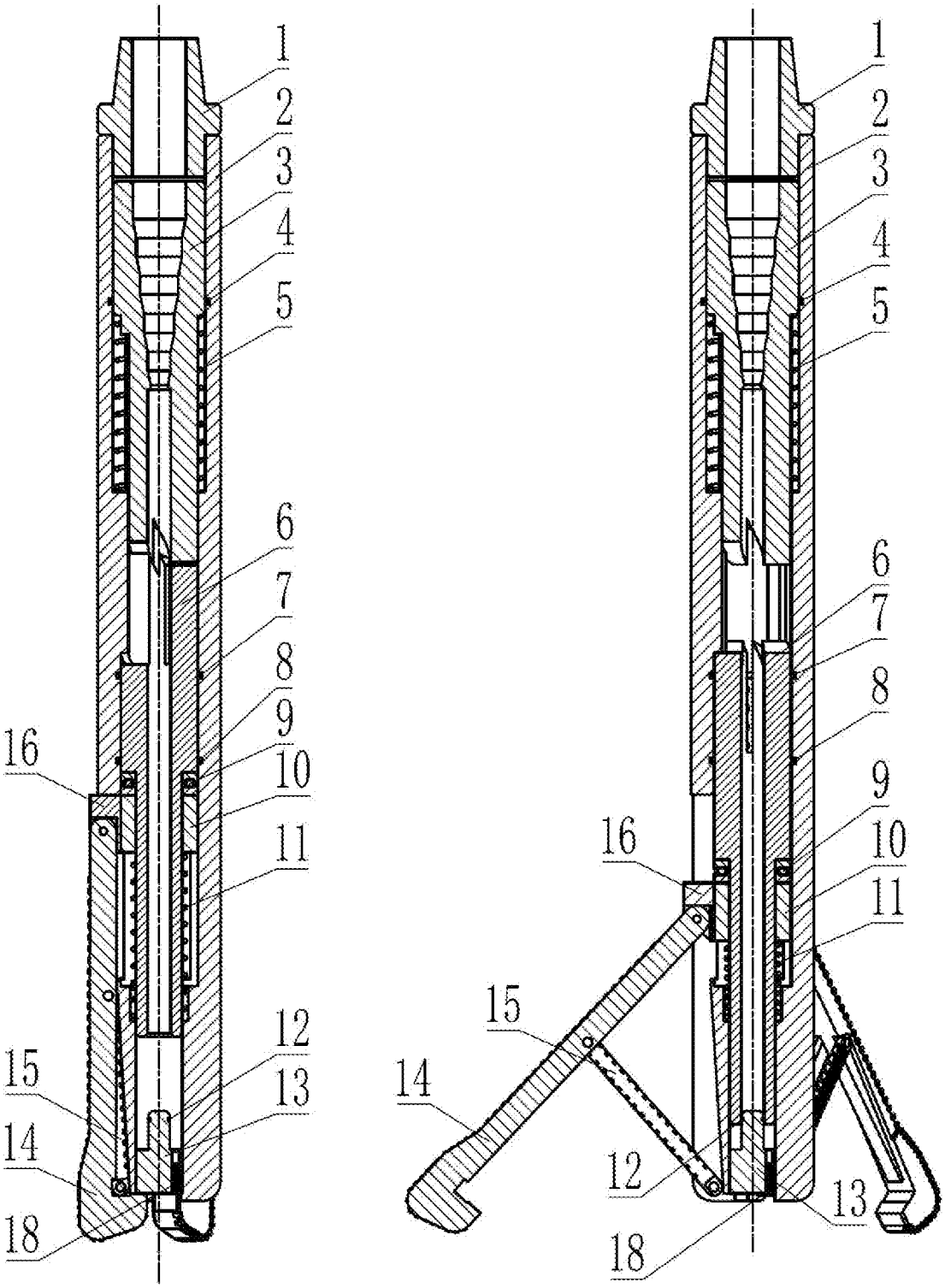
FIG. 2 is a comparison diagram of contraction and extension of a blade according to the present invention.
Figure 3:
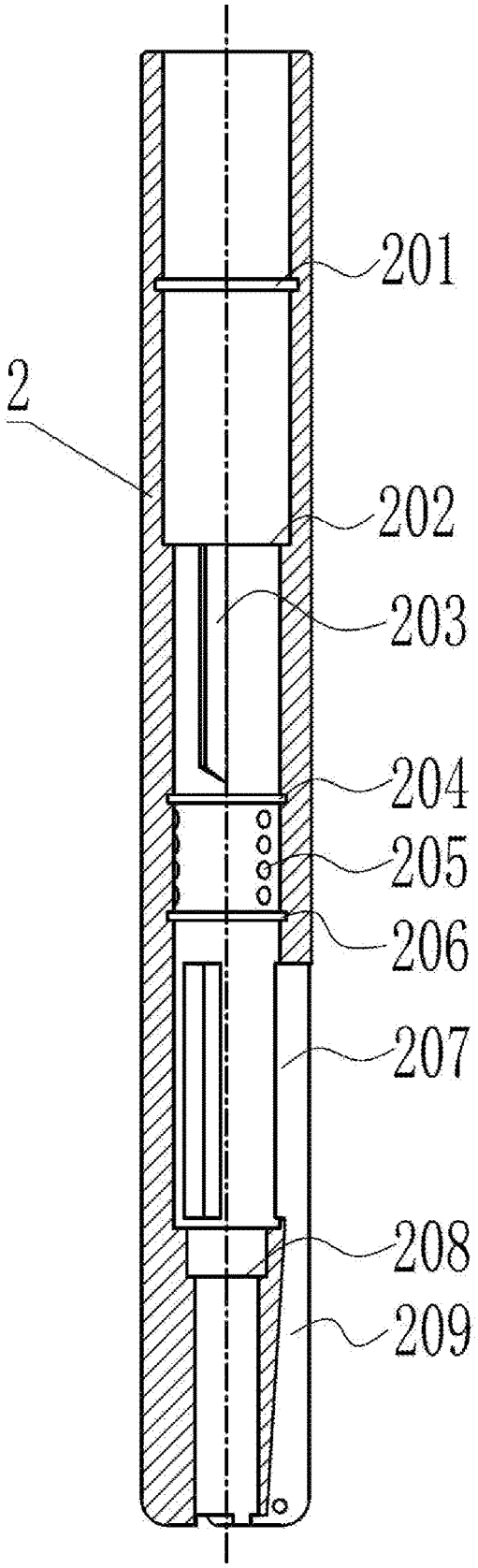
FIG. 3 is a schematic structural diagram of an outer cylinder according to the present invention.

The working process of the present invention is as follows:

Initial state: in the left figure of FIG. 2, the pressure cylinder 3 is in the top-most position under the action of the spring 15, in which case the jaw 203 of the outer cylinder 2 is stuck on the gap 603 of the jaw sleeve 6, the blade 14 is in a closed state, the drill bit is in normal rock-crushing drilling work, and the nozzle II 18 in the front end of the drill bit ejects a high-pressure drilling fluid to assist in crushing and cleaning the drill bit.

Figure 4:
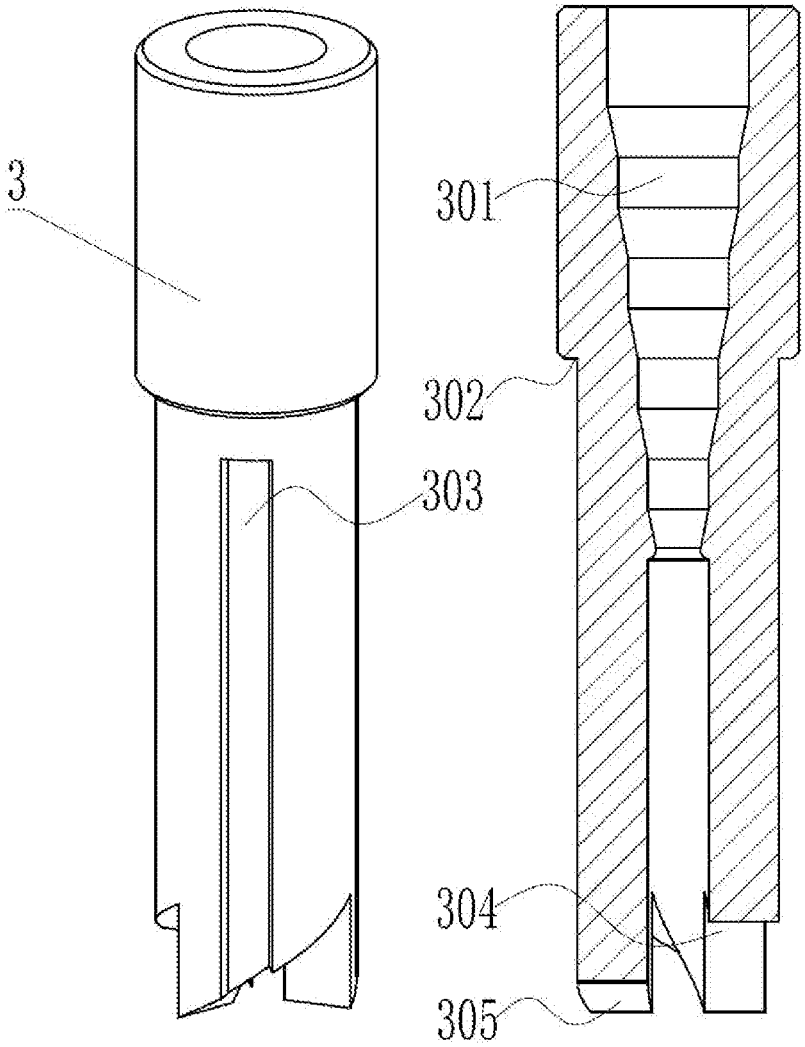
FIG. 4 is a schematic structural diagram of a pressure cylinder according to the present invention.
Figure 5:
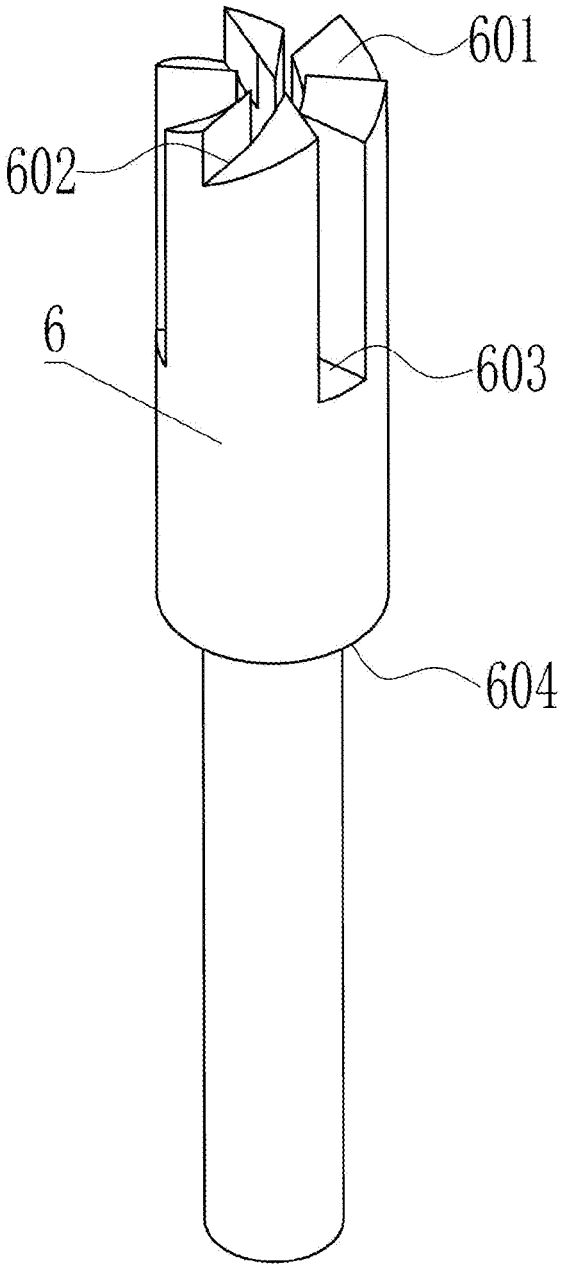
FIG. 5 is a schematic structural diagram of a jaw sleeve according to the present invention.
Figure 6:
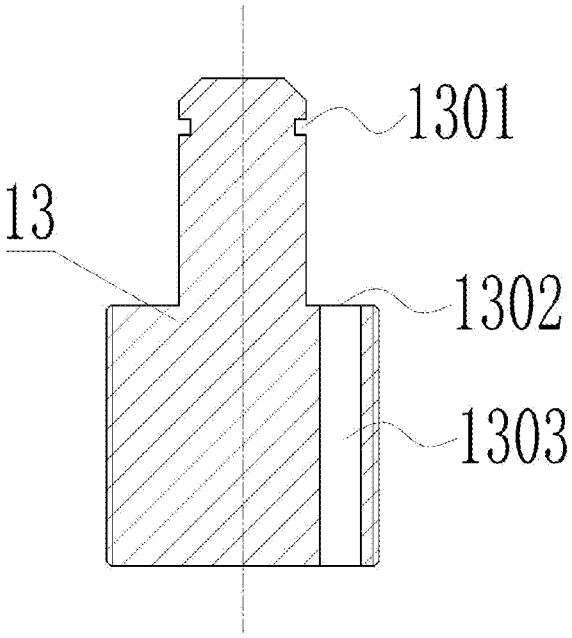
FIG. 6 is a schematic structural diagram of an end cap according to the present invention.
Figure 7:
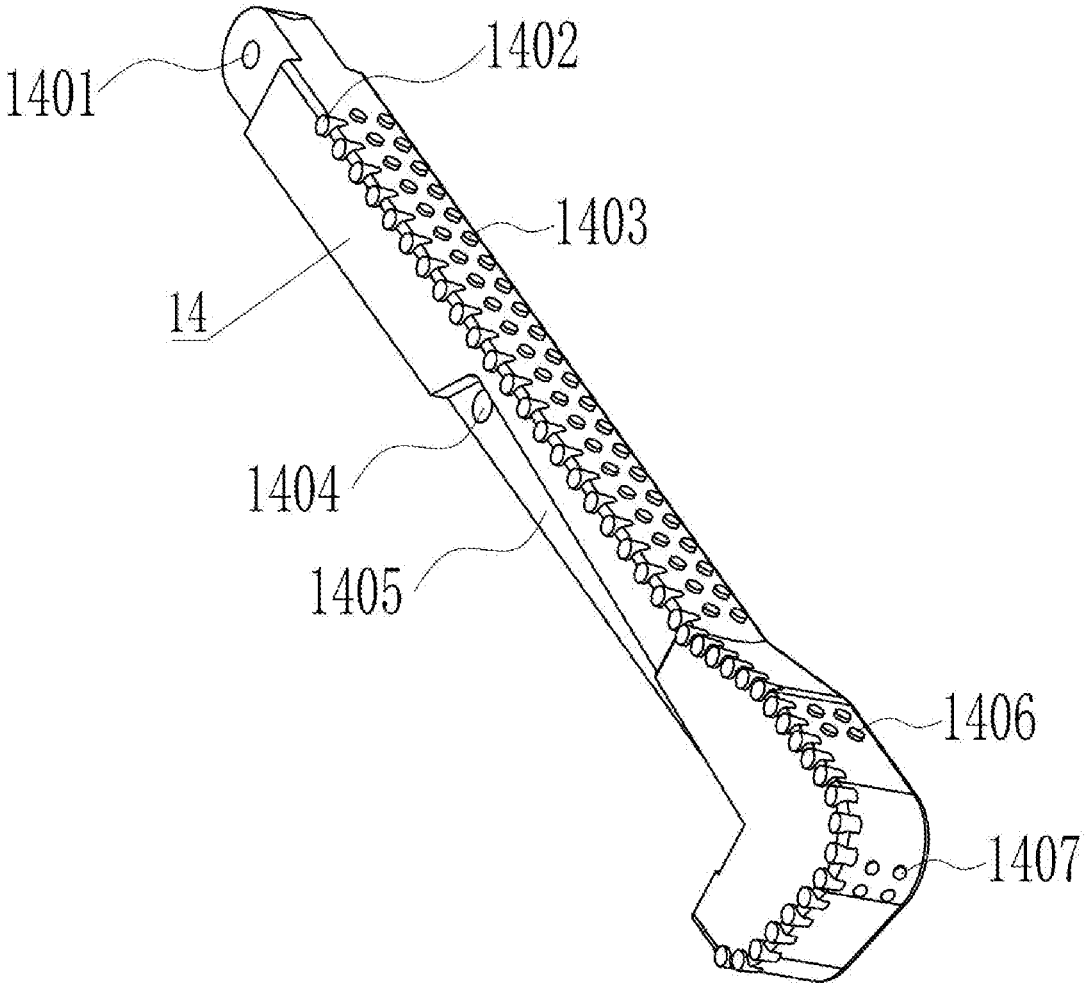
FIG. 7 is a schematic structural diagram of a blade according to the present invention.
Figure 8:
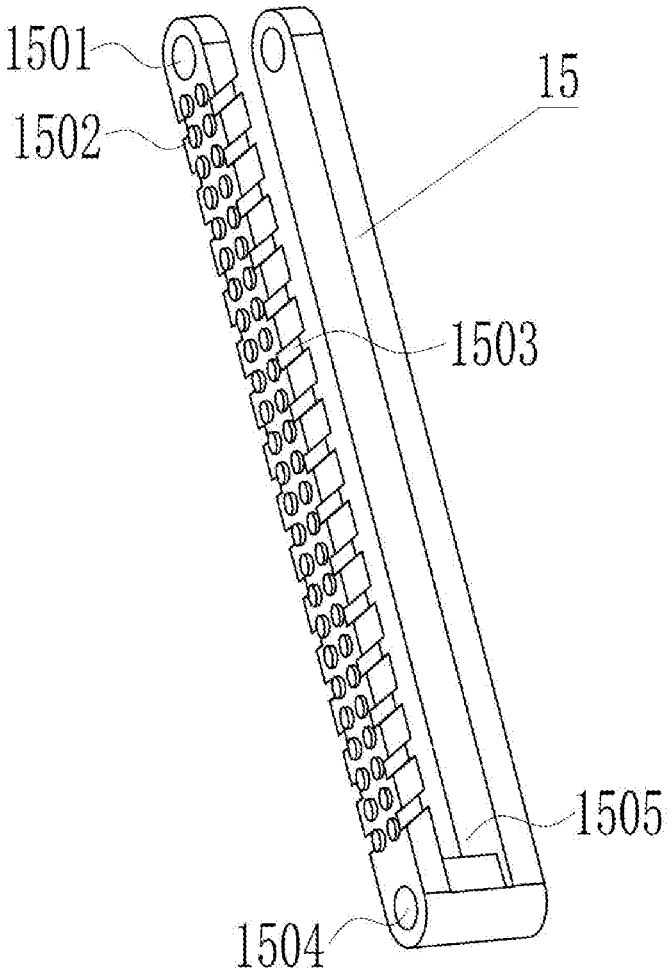
FIG. 8 is a schematic structural diagram of a secondary crushing connecting rod according to the present invention.
Figure 9:
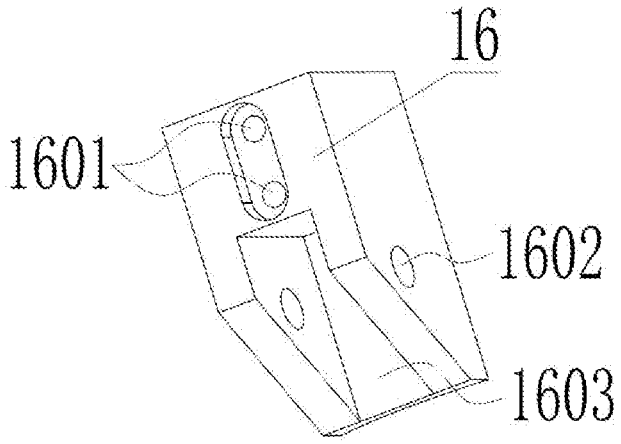
FIG. 9 is a schematic structural diagram of a blade connecting base according to the present invention.
Figure 10:
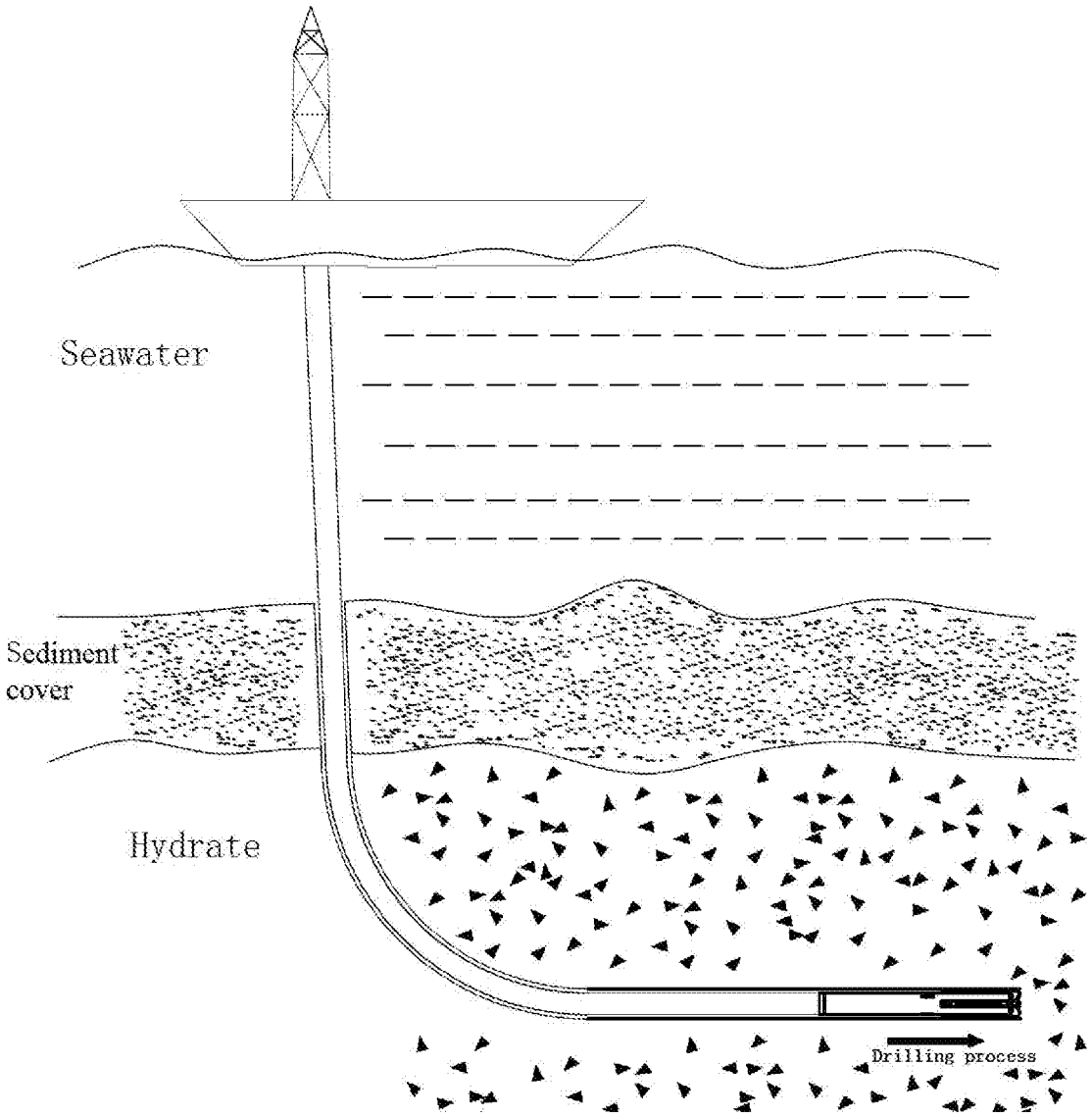
FIG. 10 is a schematic view of a drilling operation of a drill bit according to the present invention.
Figure 11:
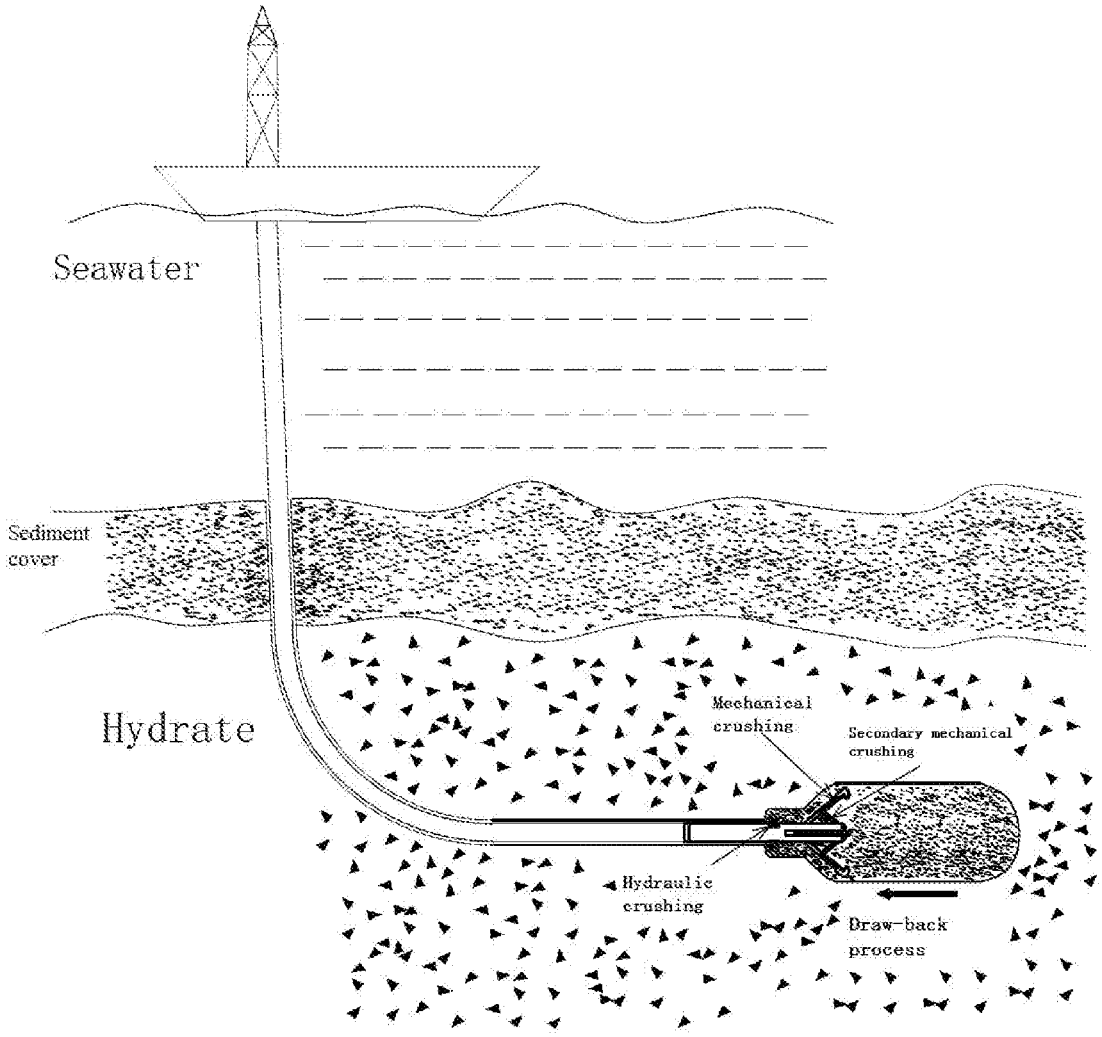
FIG. 11 is a schematic view of a draw-back operation of the drill bit according to the present invention.
Figure 12:
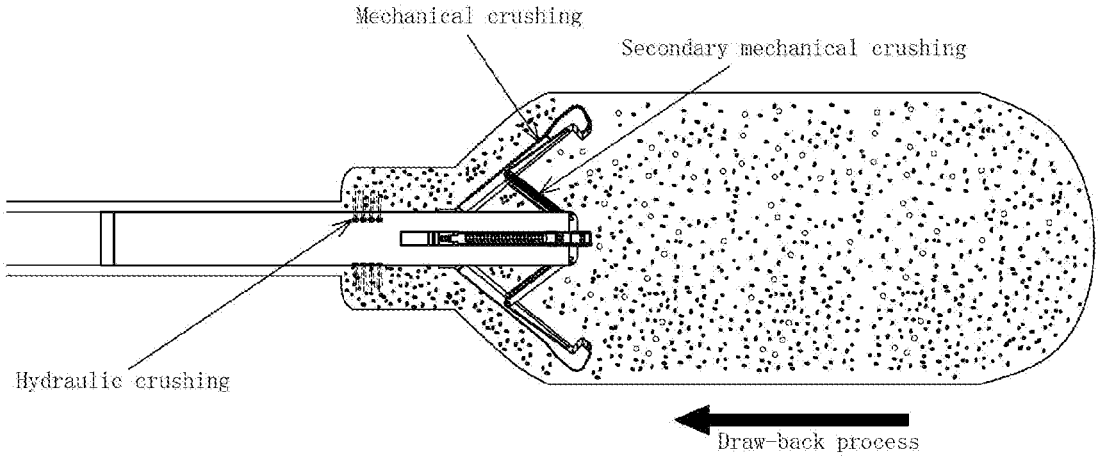
FIG. 12 is a schematic enlarged view of positions of the drill bit during the draw-back operation according to the present invention.

Operating state I: referring to FIG. 4, the flow rate of the drilling fluid is increased, and when the drilling fluid passes through the necked step opening 301 of the pressure cylinder 3, due to a flow channel change, the drilling fluid exerts a great pressure on the pressure cylinder 3 to cause the pressure cylinder 3 to push the jaw sleeve 6 to move downward; when the pressure cylinder 3 is at the lowest end of the stroke, the jaws 203 leave the gap 603 on the jaw sleeve 6, and the jaw sleeve 6 rotates because the helical surfaces I 305 of the pressure cylinder 3 coordinate with the helical surfaces II 601 of the jaw sleeve 6; moreover, while the jaw sleeve 6 moves downward, the thrust ball bearing 9 and the sliding cylinder 10 are driven to move downward, the sliding cylinder 10 drives the blade connecting base 16 to move downward, and the blade 14 is opened through coordination of the blade connecting base 16, the secondary crushing connecting rod 15 and the blade 14; moreover, with the downward movement of the jaw sleeve 6, the gap 603 of the jaw sleeve 6 rotates to the nozzle hole I 205, in which case the high-pressure drilling fluid is ejected from the nozzle I 17, the hydrate begins to be crushed by hydraulic force, the flow rate of the drilling fluid is reduced after a certain period of time, so that the pressure of the drilling fluid on the pressure cylinder 3 is reduced. Under the action of the spring 15 and the spring II 11, the pressure cylinder 3 and the jaw sleeve 6 begin to rebound, in which case the helical surfaces II 601 of the jaw sleeve 6 come into contact with an inclined surface of the jaws 203 and rotates, so that the jaws 203 are stuck to the sections 602 of the jaw sleeve 6, to implement a function of mechanically locking the blade 14. At this point, the blade 14 has extended out, and normal mechanical crushing and secondary mechanical crushing of the hydrate start. Besides, with the downward movement of the jaw sleeve 6, the lower end of the jaw sleeve 6 coordinates with the end cap 13 and the sealing ring IV 12 to achieve the plugging of the nozzle II 18, and the nozzle II 18 stops operating.

Operating state II: if the drill bit is stuck when crushing the hydrate or when the drill bit is retracted after crushing, similar to the previous working process, the flow rate of the drilling fluid is increased, and when the drilling fluid passes through the necked step opening 301 of the pressure cylinder 3, due to a flow channel change, the drilling fluid exerts a great pressure on the pressure cylinder 3 to cause the pressure cylinder 3 to push the jaw sleeve 6 to move downward; when the pressure cylinder 3 is at the lowest end of the stroke, the jaws 203 leave the section 602 on the jaw sleeve 6, and the jaw sleeve 6 rotates because the helical surfaces I 305 of the pressure cylinder 3 coordinate with the helical surfaces II 601 of the jaw sleeve 6. The flow rate of the drilling fluid is reduced after a certain period of time, so that the pressure on the pressure cylinder 3 is reduced. Under the action of the spring I 5 and the spring II 11, the pressure cylinder 3 and the jaw sleeve 6 begin to rebound, in which case the helical surfaces II 601 of the jaw sleeve 6 come into contact with an inclined surface of the jaws 203 and rotates, so that the jaws 203 are stuck to the gaps 603 of the jaw sleeve 6, the jaw sleeve 6 and the sliding cylinder 10 continue to move upward under the action of the spring II 11, the blade 14 is retracted and mechanically locked through the blade connecting base 16; at the same time, the gaps 603 of the jaw sleeve 6 rotate away from the nozzle holes I 205, the nozzle I 17 and the blade 14 stop crushing the hydrate.

The above steps are repeated when an expanding operation is required again.

Finally, it should be noted that, the above embodiments are intended only to describe instead of limiting the technical solution of the present invention. Although the present invention is described in detail with reference to the above embodiments, those of ordinary skill in the art should understand that the patent may still be amended or equally replaced. Any modification or partial replacement without departing from the spirit and scope of the present invention shall all be covered within the scope of the claims of the present invention.

What is claimed is:

1. A combined crushing super-variable-diameter drill bit for natural gas hydrate exploitation, comprising: a joint (1), an outer cylinder (2) connected to the joint (1) by thread, a nozzle I (17) mounted in the outer cylinder (2), a mechanical locking mechanism, a blade telescoping mechanism, an end cap (13) connected to the outer cylinder (2) by thread, a seal ring IV (12) mounted to the end cap (13), and three nozzles II (18) mounted in the end cap (13) by threaded connection, wherein an upper portion of the outer cylinder (2) is provided with a seal ring groove I (201), a middle-upper portion of the outer cylinder (2) is provided with a step I (202), three raised jaws (203) are circumferentially distributed in a middle portion of the outer cylinder (2), a seal ring groove II (204) is disposed below the jaws (203), three sets of nozzle holes I (205) are circumferentially disposed below the seal ring groove II (204), there are 4 holes for each set of the nozzle holes I (205), a seal ring groove III (206) is disposed below the nozzle holes I (205), three rectangular through holes (207) are circumferentially disposed in a middle-lower portion of the outer cylinder (2), a lower portion of the rectangular through holes (207) is provided with a chute (209), and a step II (208) is disposed in an inner lower portion of the outer cylinder (2);

the mechanical locking mechanism comprises a pressure cylinder (3), a seal ring I (4), a spring I (5), a jaw sleeve (6), a seal ring II (7), and a seal ring III (8), an upper end of the pressure cylinder (3) abuts a lower end face of the joint (1) positioned above the pressure cylinder (3), the seal ring I (4) is disposed between the pressure cylinder (3) and the outer cylinder (2), the spring I (5) is located in the outer cylinder (2) and two ends thereof are respectively connected between a step III (302) of the pressure cylinder (3) and the step II (208) inside the outer cylinder (2), the pressure cylinder (3) is in contact with the jaw sleeve (6), and the seal ring II (7) and the seal ring III (8) are disposed between the jaw sleeve (6) and the outer cylinder (2);

the blade telescoping mechanism comprises a thrust ball bearing (9), a sliding cylinder (10), a spring II (11), a plurality of blades (14), a secondary crushing connecting rod (15), and a blade connecting base (16), the thrust ball bearing (9) is mounted between the jaw sleeve (6) and the sliding cylinder (10), the sliding cylinder (10) is in clearance fit with the jaw sleeve (6), the spring II (11) is connected between the sliding cylinder (10) and the step II (208) in the outer cylinder (2), the blade connecting base (16) is connected to the sliding cylinder (10) by bolt, upper and lower ends of the secondary crushing connecting rod (15) are respectively connected to one of the plurality of blades (14) and the outer cylinder (2) by bolt, the plurality of blades (14) are connected to the blade connecting base (16) by bolt, wherein the upper end of the secondary crushing connecting rod (15) is provided with a through hole III (1501), a left side of the secondary crushing connecting rod (15) is provided with two rows of raised crushing teeth (1502) and two rows of notches (1503), each row of the crushing teeth (1502) being adjacent to one of the two rows of notches (1503) and the two rows of notches (1503) being symmetrically arranged relative to the two row of crushing teeth (1502), the lower end of the secondary crushing connecting rod (15) is provided with a through hole IV (1504), and a groove I (1505) is disposed in the middle of the secondary crushing connecting rod (15), to make the secondary crushing connecting rod (15) take the shape of a fork;

an upper end of the end cap (13) is provided with a seal ring groove IV (1301) for receiving the seal ring IV (12), the middle of the end cap (13) is provided with a step V (1302), and the end cap (13) is circumferentially provided with three nozzle holes II (1303); and the nozzles II (18) are mounted in the nozzle holes II (1303) in the end cap (13), wherein in one of the nozzle holes II (1303) one of the nozzles II (18) is mounted.

2. The combined crushing super-variable-diameter drill bit for natural gas hydrate exploitation according to claim 1, wherein in the mechanical locking mechanism, the pressure cylinder (3) is provided with a necked step opening (301), the step III (302), three recesses (303), and three helical surfaces I (305), the necked step opening (301) is disposed on the inside of the pressure cylinder (3), the step III (302) is disposed on the outside of the pressure cylinder (3), the three recesses (303) are disposed along a circumferential direction of an outer wall of the pressure cylinder (3), the three helical surfaces I (305) are disposed at a lower end of the pressure cylinder (3), and three sections (304) are disposed on the three helical surfaces I (305);

an upper end of the jaw sleeve (6) is provided with six helical surfaces II (601), three sections (602), three gaps (603), and a step IV (604), the three sections (602) and the three gaps (603) are intersected between every two helical surfaces II (601), and the step IV (604) is disposed in the middle of the jaw sleeve (6); and the recesses (303) match with the jaws (203), and the helical surfaces I (305) on the pressure cylinder (3) are in contact with the helical surfaces II (601) on the jaw sleeve (6).

3. The combined crushing super-variable-diameter drill bit for natural gas hydrate exploitation according to claim 1, wherein in the blade telescoping mechanism, each of the plurality of blades (14) comprises a through hole I (1401), cutting teeth (1402), flat teeth (1403), a through hole II (1404), a triangular groove (1405), flat teeth (1406), and ball teeth (1407), the through hole I (1401) is disposed on an upper end of one of the plurality of blades (14), the cutting teeth (1402) are uniformly disposed along edges of one of the plurality of blades (14), two rows of flat teeth (1403) are disposed on an outer side of one of the plurality of blades (14), the through hole II (1404) is disposed in a middle portion of one of the plurality of blades (14), the triangular groove (1405) is disposed on one of the plurality of blades (14), the flat teeth (1406) of the plurality of blades (14) are disposed a lower outer side of the plurality of blade (14), and the ball teeth (1407) are disposed at a lower ends of the plurality of blade (14); the blade connecting base (16) is provided with a bolt through hole (1601), a through hole V (1602), and a groove II (1603); the blade connecting base (16) is connected to the sliding cylinder (10) through a bolt through hole (1601) by using a bolt, the through hole I (1401) is connected to the through hole V (1602) by bolt, to make the plurality of blades (14) connected to the blade connecting base (16), the through hole II (1404) is connected to the through hole III (1501), to make the middle portions of the plurality of blades (14) connected to the secondary crushing connecting rod (15), and the secondary crushing connecting rod (15) is connected to the outer cylinder (2) through the through hole IV (1504).

4. The combined crushing super-variable-diameter drill bit for natural gas hydrate exploitation according to claim 1, wherein when the device is drilling, the plurality of blades (14) are closed, front ends of plurality of blades (14) form a drill bit to drill forward, and the nozzle II (18) assists in crushing; when the drill bit drills to the end of a hydrate layer, the plurality of blades (14) begin to open, and the nozzle I (17) on the outer cylinder (2) is opened while the blades (14) are opened, to achieve hydrate hydraulic crushing; after the plurality of blades (14) are opened, the plurality of blades (14) are combined in an umbrella shape, and the drill bit begins to draw back, in which case the plurality of blades (14) rotate to crush the hydrate to achieve mechanical crushing of the hydrate; the secondary crushing connecting rod (15) rotates while the plurality of blades (14) rotate, the crushing teeth (1502) and the notches (1503) on the secondary crushing connecting rod (15) coordinate with each other to continue to crush the hydrate to achieve secondary mechanical crushing of the hydrate.

* * * * *